US009657447B2

(12) United States Patent
Mattson

(10) Patent No.: US 9,657,447 B2
(45) Date of Patent: May 23, 2017

(54) MODULAR SCREED BOX

(71) Applicant: Graco Minnesota Inc., Minneapolis, MN (US)

(72) Inventor: Barry W. Mattson, Elk River, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 109 days.

(21) Appl. No.: 14/688,506

(22) Filed: Apr. 16, 2015

(65) Prior Publication Data

US 2015/0330038 A1 Nov. 19, 2015

Related U.S. Application Data

(60) Provisional application No. 61/993,361, filed on May 15, 2014.

(51) Int. Cl.
*E01C 23/16* (2006.01)
*E01C 23/24* (2006.01)

(52) U.S. Cl.
CPC ..... *E01C 23/24* (2013.01); *E01C 23/16* (2013.01)

(58) Field of Classification Search
USPC .... 404/93, 94, 108, 111, 118; 239/150, 504, 239/506, 509, 510, 512, 518, 524, 589; 118/410, 415
See application file for complete search history.

(56) References Cited

U.S. PATENT DOCUMENTS 1,857,242 A * 5/1932 Edmondson ..... D06B 3/10 118/412
2,612,374 A 9/1952 Wilson
2,672,842 A * 3/1954 Winters ..... B05B 13/02 118/301
3,373,669 A * 3/1968 Schmitz ..... E01C 19/15 404/110
3,415,173 A 12/1968 Paul
3,515,041 A 6/1970 Murtaugh
3,702,578 A 11/1972 Davin
3,712,189 A 1/1973 Birtchet et al.
4,276,852 A * 7/1981 Adams ..... B05B 15/04 118/301
4,356,216 A * 10/1982 Gailey ..... B05C 3/18 118/411
4,476,165 A * 10/1984 McIntyre ..... B05C 5/0254 118/411
4,802,788 A 2/1989 Smith
(Continued)

*Primary Examiner* — Thomas B Will
*Assistant Examiner* — Katherine Chu
(74) *Attorney, Agent, or Firm* — Kinney & Lange, P.A.

(57) ABSTRACT

A screed box includes a screed bucket, a screed plate mount attached to the screed bucket, a screed plate slidably connected to the screed plate mount and a screed bar attached to a bottom of the screed bucket. The screed plate mount includes a sealing edge. The screed plate includes at least one screed flange. The screed bar includes a body and a sealing lip including at least one projection. The screed bar is slidable between an open position where the sealing lip engages the sealing edge and a closed position where the sealing lip is disengaged from the sealing edge, and the at least one projection engages the sealing edge when the screed bar is in the open position and when the screed bar is in a closed position.

11 Claims, 14 Drawing Sheets

(56) References Cited

U.S. PATENT DOCUMENTS

| | | | | | |
|---|---|---|---|---|---|
| 4,893,751 | A * | 1/1990 | Armstrong | E01C 23/22 | 118/305 |
| 5,059,062 | A | 10/1991 | Bresnahan | | |
| 5,129,356 | A * | 7/1992 | Bandy | B05C 5/027 | 118/315 |
| 5,148,988 | A * | 9/1992 | Smrt | B65D 83/203 | 118/301 |
| 5,158,394 | A | 10/1992 | Bresnahan | | |
| 5,387,051 | A * | 2/1995 | Valente | E04F 21/20 | 404/101 |
| 5,879,751 | A * | 3/1999 | Bogdanski | A61F 13/15658 | 427/189 |
| 6,102,615 | A * | 8/2000 | Wilson, Sr. | E01C 19/16 | 118/108 |
| 6,203,243 | B1 | 3/2001 | Birtchet | | |
| 6,227,454 | B1 | 5/2001 | Wolf et al. | | |
| 6,796,740 | B2 * | 9/2004 | Chiron | E01C 23/166 | 404/14 |
| 7,070,358 | B2 | 7/2006 | Hicks | | |
| 7,584,902 | B2 * | 9/2009 | Sibbers | E01C 23/243 | 239/100 |
| 8,113,736 | B2 * | 2/2012 | Wilson, Sr. | C04B 24/2641 | 404/101 |
| 8,517,630 | B2 | 8/2013 | Graham et al. | | |
| 8,899,872 | B2 * | 12/2014 | Triplett | E01C 23/16 | 404/101 |

* cited by examiner

MODULAR SCREED BOX

CROSS-REFERENCE TO RELATED APPLICATION(S)

This application claims priority from U.S. Provisional Application No. 61/993,361, entitled "MODULAR SCREED BOX," filed May 15, 2014 by Barry W. Mattson.

BACKGROUND

The present invention relates generally to pavement marking, and more particularly to the line width and thickness mechanisms for a thermoplastic line striper.

Alkyd and hydrocarbon thermoplastics are commonly used to mark pavement surfaces with visible lines and symbols such as lane dividers and guide lines. In particular, thermoplastics provide a durable alternative to pavement painting, and are commonly used to mark street intersections, parking lots, and other high-traffic pavement surfaces from which paint would quickly wear away.

Thermoplastics are conventionally applied to pavement surfaces using a mobile applicator comprising a heated reservoir or kettle, and an application screed die. Melted thermoplastic is dispensed from the kettle at a controlled rate and applied in a thin layer atop pavement surfaces with the screed die. Conventional thermoplastics must be brought to melt temperatures of 177 to 250° C. (350 to 480° F.) prior to application. Existing systems use a central mixer-melter to bring thermoplastics to these temperatures. Once melted, a load of thermoplastic from the central mixer-melter is transferred to the kettle of a mobile applicator for pavement marking. The applicator kettle is heated to prevent thermoplastic from resolidifying before it is applied to the pavement surface. Often, a single central mixer-melter may service a plurality of applicators on a job site.

In general, governmental regulations determine the thickness of the thermoplastic being applied to the road surface. In addition, other environmental factors can change the application parameters (such as ambient temperature and surface roughness). Governmental regulations also generally determine the width and number of stripes that are applied. In existing systems, the width of the screed die box determines the width of the stripe of thermoplastic being applied. A modular screed die box allows the user to compensate for such variables.

SUMMARY

In one embodiment of the present invention, a screed box includes a screed bucket, a screed plate mount attached to the screed bucket, a screed plate slidably connected to the screed plate mount, and a screed bar attached to a bottom of the screed bucket. The screed plate mount includes a sealing edge. The screed plate includes at least one screed flange. The screed bar includes a body and a sealing lip including at least one projection. The screed bar is slidable between an open position where the sealing lip engages the sealing edge and a closed position where the sealing lip is disengaged from the sealing edge. The at least one projection engages the sealing edge both when the screed bar is in the open position and in the closed position. The sealing edge, the sealing lip, and the at least one projection define at least one opening when the screed bar is in the open position.

In another embodiment of the present invention, a mobile applicator includes a frame, a plurality of wheels rotatably connected to the frame, a kettle attached to the frame and holding a thermoplastic material, and a screed box positioned to receive thermoplastic material from the kettle. The screed box includes a screed bucket, a screed plate mount attached to the screed bucket, a screed plate slidably connected to the screed plate mount, and a screed bar attached to a bottom of the screed bucket. The screed plate mount includes a sealing edge. The screed plate includes at least one screed flange. The screed bar includes a body and a sealing lip including at least one projection. The screed bar is slidable between an open position where the sealing lip engages the sealing edge and a closed position where the sealing lip is disengaged from the sealing edge. The at least one projection engages the sealing edge both when the screed bar is in the open position and in the closed position. The sealing edge, the sealing lip, and the at least one projection define at least one opening when the screed bar is in the open position.

In yet another embodiment of the present invention, a screed bar for a thermoplastic line striper includes a longitudinally-extending body, a sealing lip, and a projection. The longitudinally-extending body has a fore end, an aft end, a top, a bottom, a first side, and a second side. The sealing lip extends aft from the bottom of the body. The projection extends horizontally from the sealing lip.

In another embodiment of the present invention, a screed plate for a thermoplastic line striper includes a vertical portion and a horizontal portion. The vertical portion includes a top edge, a lower lip disposed opposite the top edge, a first screed flange extending from the lower lip, and a body extending between the top edge and the lower lip. The horizontal portion projects perpendicularly from the top edge of the vertical portion.

DETAILED DESCRIPTION

Figure 1:
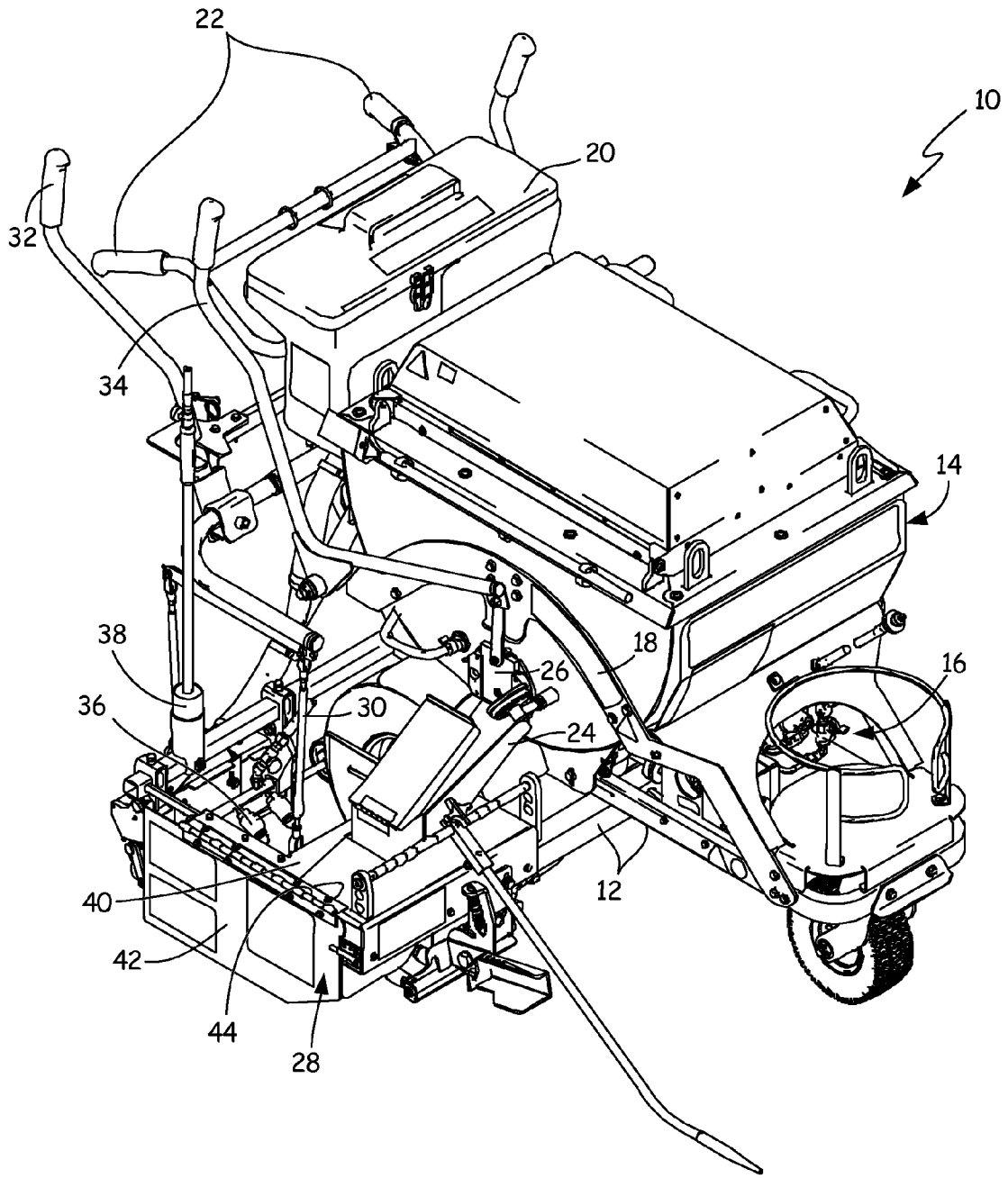
FIG. 1 is a perspective view of a mobile applicator.

FIG. 1 is a perspective view of mobile applicator 10. Mobile applicator 10 includes frame 12, kettle 14, gas system 16, kettle supports 18, bead reservoir 20, push bars 22, chute 24, gate valve 26, screed enclosure 28, screed actuator link 30, screed actuator lever 32, gate valve lever 34, screed box burners 36, and hand torch 38. Screed enclosure 28 includes screed enclosure top 40 and screed shroud door 42 connected at shroud door hinges 44.

Mobile applicator 10 is utilized to mark pavement lines on a pavement surface by melting and applying a thermoplastic material to the pavement surface. Frame 12 supports mobile applicator 10 and various other components of mobile applicator 10. Frame 12 may be made of any suitable supporting material, including a framework of aluminum, steel, or both. Kettle 14 is mounted to a top of frame 12. Kettle 14 receives granular thermoplastic, and kettle 14 is heated to melt the granular thermoplastic for application to pavement surfaces.

Gate valve 26 is located at a bottom right side of kettle 14. Gate valve 26 is positioned between and separates an interior of kettle 14 from chute 24. Chute 24 is a rigid, heat-resistant chute or trough which guides molten thermoplastic from kettle 14 to screed box (shown in FIG. 2). While directional terms such as "forward," "aft," "bottom," "top," "right side," and "left side" may be used in describing the invention, one skilled in the art can appreciate that such terms are merely relational descriptors of the illustrated embodiments shown herein.

Gas system 16 is located beneath kettle 14 and kettle supports 18, and is anchored to frame 12. Gas system 16 provides combustible gas to burners to heat kettle 14 and melt thermoplastic material. Gas system 16 also provides combustible gas to screed box burners 36 and hand torch 38. Hand torch 38 is a handheld burner which can be used to touch-up or remove thermoplastic that has been applied using mobile applicator 10.

Screed enclosure 28 is anchored to frame 12 at the bottom right side of frame 12. Screed enclosure 28 includes screed enclosure top 40 and screed shroud door 42, which is connected to screed enclosure 28 by shroud door hinges 44. Screed enclosure 28 surrounds screed box burners 36 and screed die box (shown in FIG. 2). Screed shroud door 42 can be pivoted upward from shroud door hinges 44 to allow a user to reach, remove, insert, or change components of the screed die box. Screed enclosure 28 shields the screed die box from wind and debris, while also shielding the user from molten thermoplastic.

During operation, the user ignites the pilot burners and main burners located under kettle 14. The user then deposits a sack of granular thermoplastic within kettle 14, which is melted by the main burners. Once the thermoplastic is melted, the user can pull gate valve lever 34 to open gate valve 26. Opening gate valve 26 allows molten thermoplastic to flow from kettle 14 down chute 24 and into the screed box. Screed box burners 36 heat the screed box, which ensures that the thermoplastic remains molten as it is dispensed. In some applications, light-reflective beads are used to provide increased visibility to the thermoplastic stripes. The beads are usually formed of glass, and are deposited on freshly applied molten thermoplastic. As such, some embodiments of mobile applicator 10 include bead reservoir 20, which stores the light-reflective beads until the beads are deposited through a bead tube as the thermoplastic is applied.

Mobile applicator 10 applies thermoplastic stripes to pavement by melting thermoplastic in kettle 14, transferring the thermoplastic to the screed die box via gate valve 26 and chute 24, and dispensing the molten thermoplastic onto the pavement. The thermoplastic stripe is created as the user propels mobile applicator 10. While mobile applicator 10 is described as being propelled by the user, it is understood that mobile applicator 10 may be propelled in any suitable manner, such as by attaching mobile applicator 10 to a vehicle.

Figure 2:
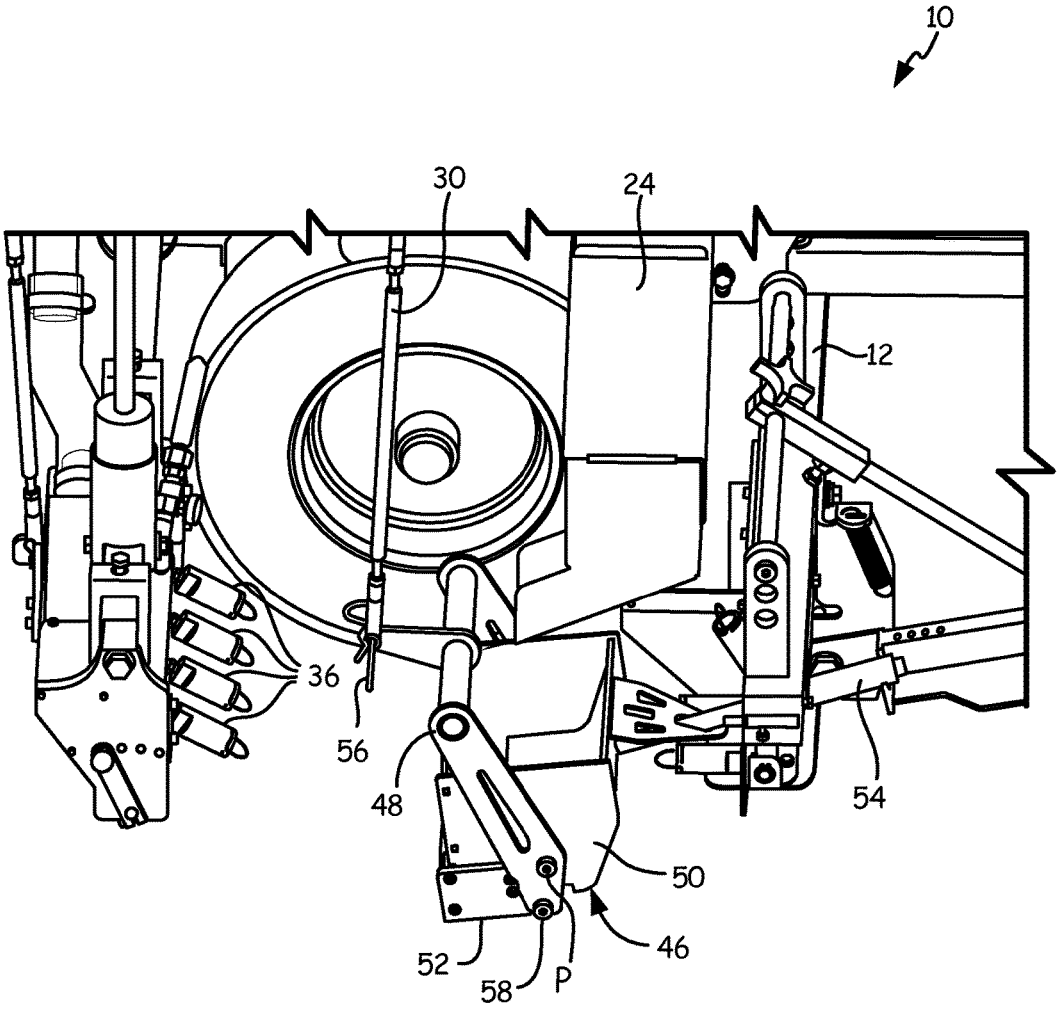
FIG. 2 is a perspective view of a screed die box of the mobile applicator.

FIG. 2 is a close-up perspective view of screed die box 46 and surrounding components of mobile applicator 10, with screed enclosure 28 removed for increased visibility. FIG. 2 shows frame 12, chute 24, screed actuator link 30, screed burners 36, and screed die box 46. Screed die box 46 includes screed lever 48, screed bucket 50, screed bar 52, screed box anchor 54, retention pin 56, bolt 58, and pivot point P.

Screed die box 46 is located below chute 24 to receive molten thermoplastic from kettle 14 (shown in FIG. 1) through chute 24. In the present embodiment, screed bucket 50 is a five-sided container open on top to receive thermoplastic from chute 24. Screed bucket 50 is anchored relative to other components of mobile applicator 10 by screed box anchor 54, which is attached to a forward side of screed bucket 50. Screed box anchor 54 is shown as an elongate post that extends through and can be locked into place relative to frame 12. This configuration of screed box anchor 54 allows screed box anchor 54 to function as a handle for carrying and moving screed box 46. Screed box anchor 54 can be locked in place anywhere along the length of screed box anchor 54, allowing the position of screed box 46 to be adjusted for various applications. It is understood that screed box anchor 54 may take any suitable form for securing screed box 46 relative to frame 12.

Screed lever 48 is secured to bolt 58, and bolt 58 projects into screed bar 52. Screed bar 52 is a slidable plate that slides along the bottom of screed bucket 50. Screed lever 48 is detachably attached to screed actuator link 30 by retention pin 56. When screed actuator lever 32 (shown in FIG. 1) is pulled, screed actuator link 30 is forced downward, which applies a torque to screed lever 48 such that screed lever 48 rotates about pivot point P. Screed lever 48 rotates aftward, which causes screed lever 48 to exert a forward force on bolts 58. Bolts 58 thereby cause screed bar 52 to slide forward, opening a gap in the bottom, aft portion of screed bucket 50 through which thermoplastic material can flow.

Figure 3A:
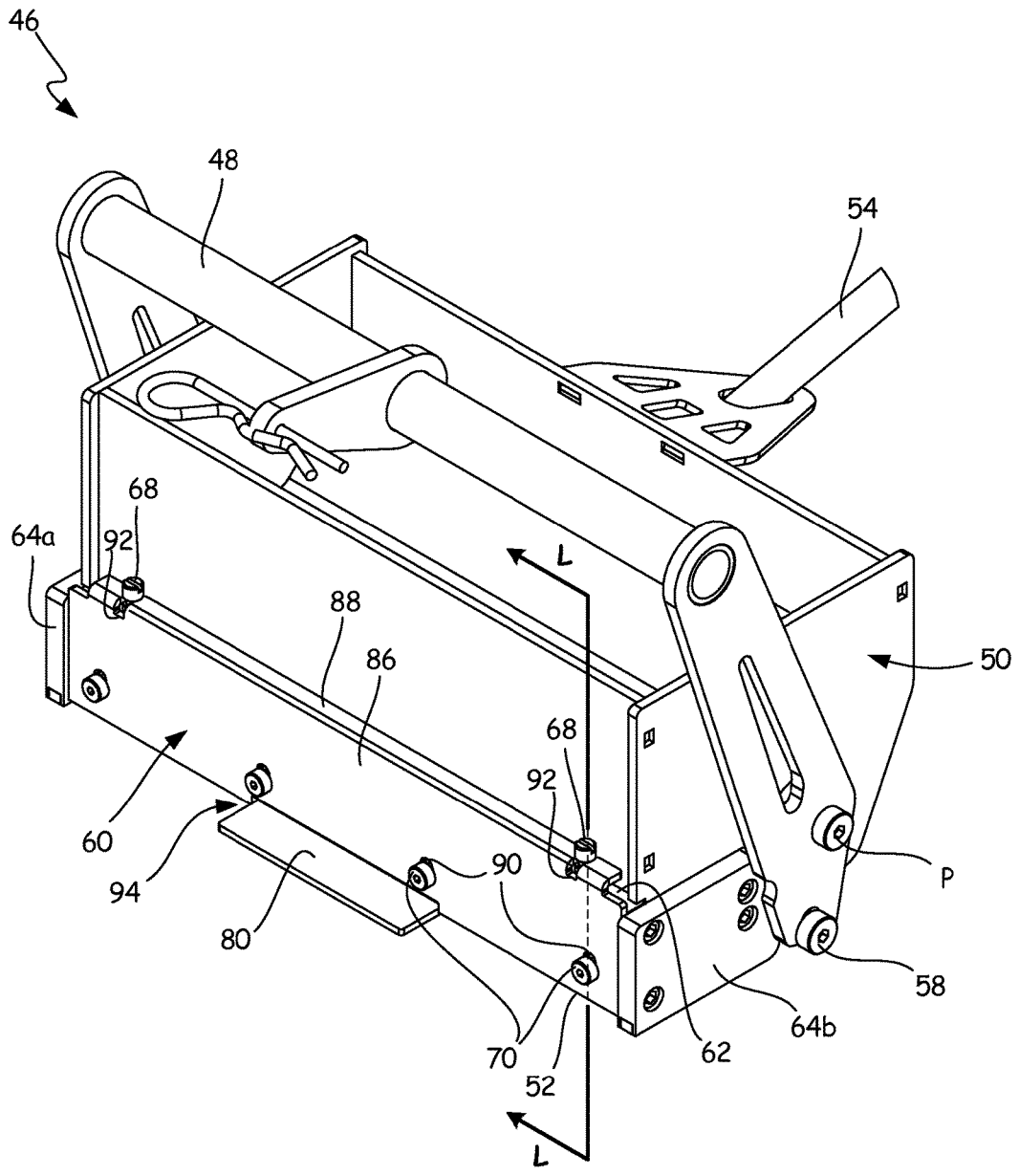
FIG. 3A is a perspective view of a screed die box.
Figure 3B:
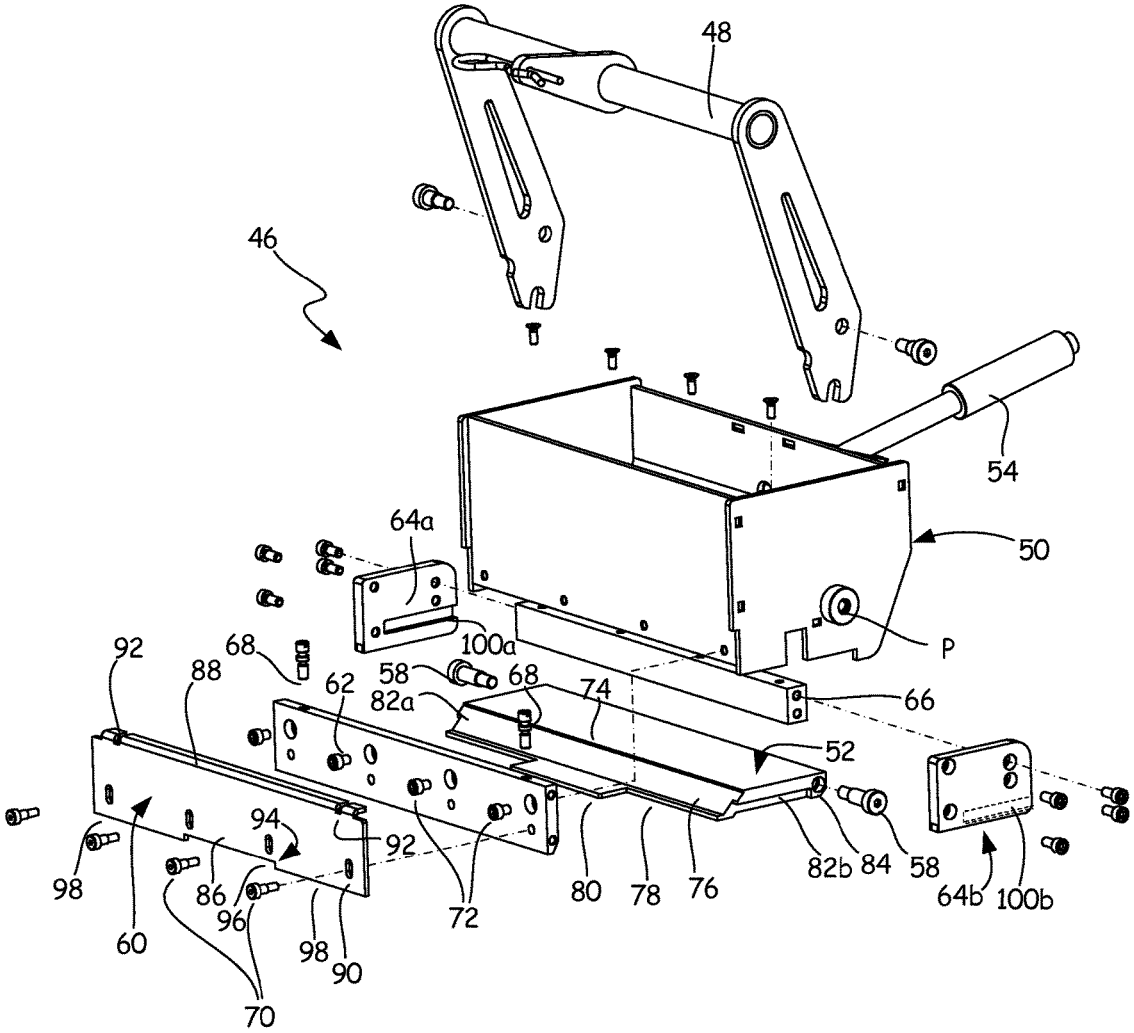
FIG. 3B is an exploded perspective view of the screed die box of FIG. 3A.

FIG. 3A is a perspective view of screed die box 46. FIG. 3B is an exploded perspective view of screed die box 46. FIGS. 3A and 3B will be discussed together. Screed die box 46 includes screed lever 48, screed bucket 50, screed bar 52, screed box anchor 54, bolts 58, screed plate 60, screed plate mount 62, screed bar mounts 64*a* and 64*b*, support bar 66, positioning screws 68, retaining screws 70, mount screws 72, and pivot point P.

In the illustrated embodiment, screed bar 52 includes body 74, sloped edge 76, sealing lip 78, projection 80, mounting rails 82*a*, 82*b*, and bolt opening 84. Screed plate 60 includes vertical portion 86, horizontal portion 88, retaining slots 90, and positioning apertures 92. Vertical portion 86 includes lower lip 94, and lower lip 94 includes notch 96 and screed flanges 98. Screed bar mount 64*a* includes slot 100*a*, and screed bar mount 64*b* similarly includes slot 100*b* (shown in phantom in FIG. 3B).

Screed plate mount 62 is attached to the aft side of screed bucket 50 by mount screws 72 that extend through screed plate mount 62 and into screed bucket 50. It is understood that although screed plate mount 62 is shown as attached to screed bucket 50 by mount screws 72, screed plate mount 62 may be an integral part of screed bucket 50. Support bar 66 is mounted to screed bucket 50 at a forward end of screed bucket 50. Screed bar mount 64*a* is positioned at a left side of screed bucket 50. Screed bar mount 64*a* is secured to screed plate mount 62 and support bar 66 by fasteners extending through screed bar mount 64*a* and into screed plate mount 62 and support bar 66. Similarly, screed bar mount 64*b* is positioned at a right side of screed bucket 50 and screed bar mount 64*b* is secured to screed plate mount 62 and support bar 66 by fasteners extending through screed bar mount 64*b* and into screed plate mount 62 and support bar 66. Screed bar 52 is slidably connected to screed bar mounts 64*a*, 64*b* by mounting rails 82*a*, 82*b* being slidably positioned within slots 100*a*, 100*b*. Bolts 58 extend into screed bar 52 forward of screed bar mounts 64*a* and 64*b*.

Screed lever 48 is mounted to screed bucket 50 at pivot point P. Screed lever 48 engages bolts 58 at screed bar 52, and screed lever 48 slidably moves screed bar 52 fore and aft by engaging and moving bolt 58 fore and aft. As screed lever 48 is rotated aft, screed lever 48 exerts a force on bolts 58 and pushes bolts 58 forward. Bolts 58 thus cause screed bar 52 to slide forward, opening a gap at the bottom, aft of screed die box 46, creating a flow path for thermoplastic to exit screed die box 46. Projection 80 extends aft of screed plate mount 62 and through notch 96 of screed plate 60. Screed flanges 98 can extend below a top of projection 80 and sealing lip 72, while notch 96 allows projection 80 to extend aft of screed plate 60 when screed flanges 98 are positioned below of top of projection 80.

In the embodiment shown, screed bar 52 is a dual-line screed bar, which means that screed bar 52 allows for two, parallel lines of thermoplastic to be set down on the pavement with a gap between the two lines. As screed lever 48 rotates aft, screed lever 48 causes screed bar 52 to slide forward. Sliding screed bar 52 forward opens flow paths on the left and right side of projection 80, which allows thermoplastic material to flow out of screed die box 46. Projection 80 defines the gap created between the two, parallel lines of thermoplastic exiting screed die box 46 through the flow paths. Screed flanges 98 are disposed within the flow paths on either side of projection 80, and screed flanges 98 affect the flow of thermoplastic leaving screed die box 46. Screed flanges 98 may extend below a top of projection 80 and sealing lip 72. Notch 96 allows screed flanges 98 to extend below of top of projection 80 and sealing lip 72, as notch 96 is configured to allow projection 80 to slide horizontally through notch 96. In this way, screed flanges 98 may extend into the flow path for thermoplastic while projection 80 prevents thermoplastic from exiting screed die box 46 and thus defines the gap between the thermoplastic flow paths.

Figure 4A:
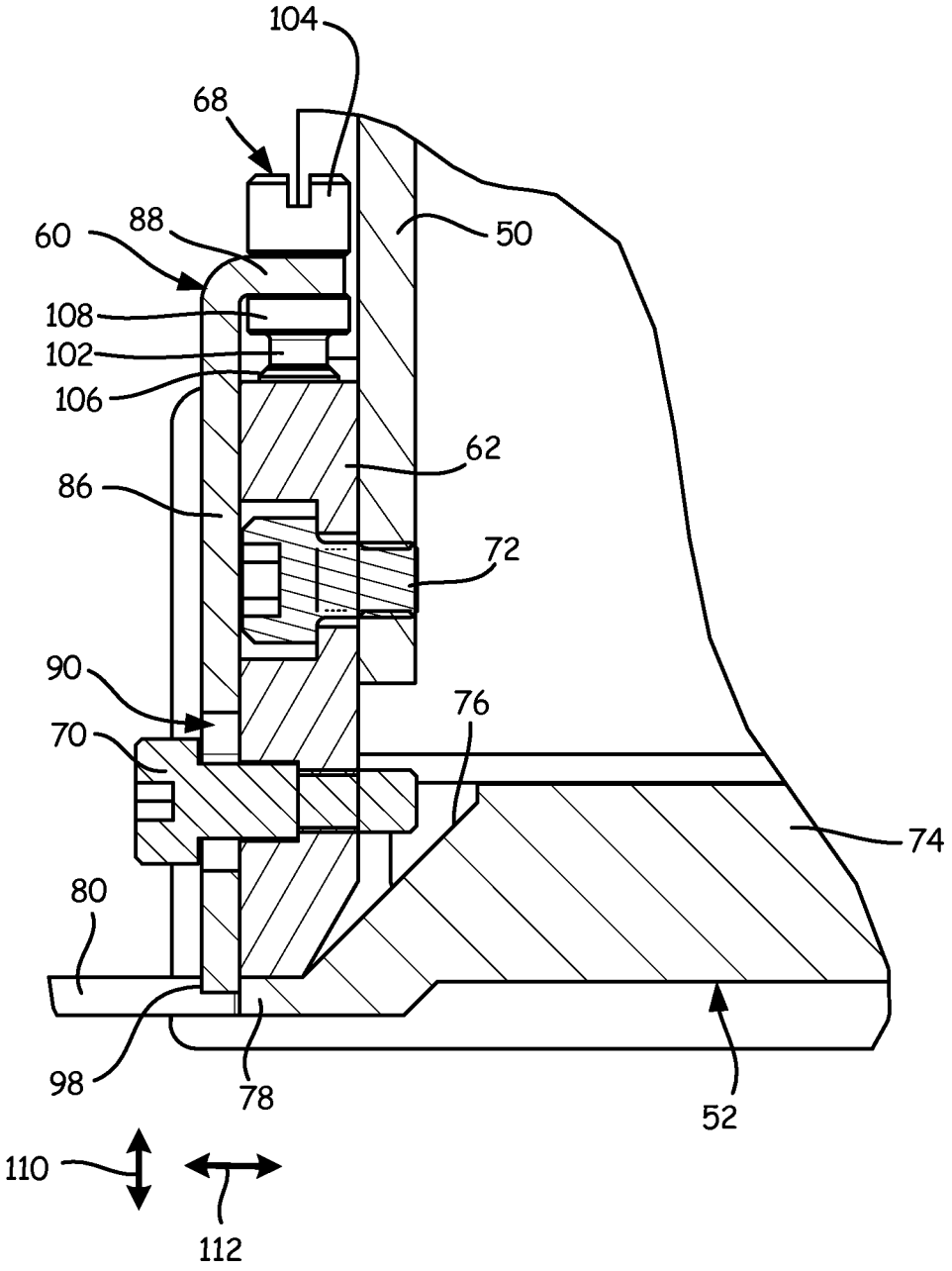
FIG. 4A is a cross-sectional view of the screed die box taken along line L-L in FIG. 3A with a dual-line screed plate fully down and a dual-line screed bar fully closed
Figure 4B:
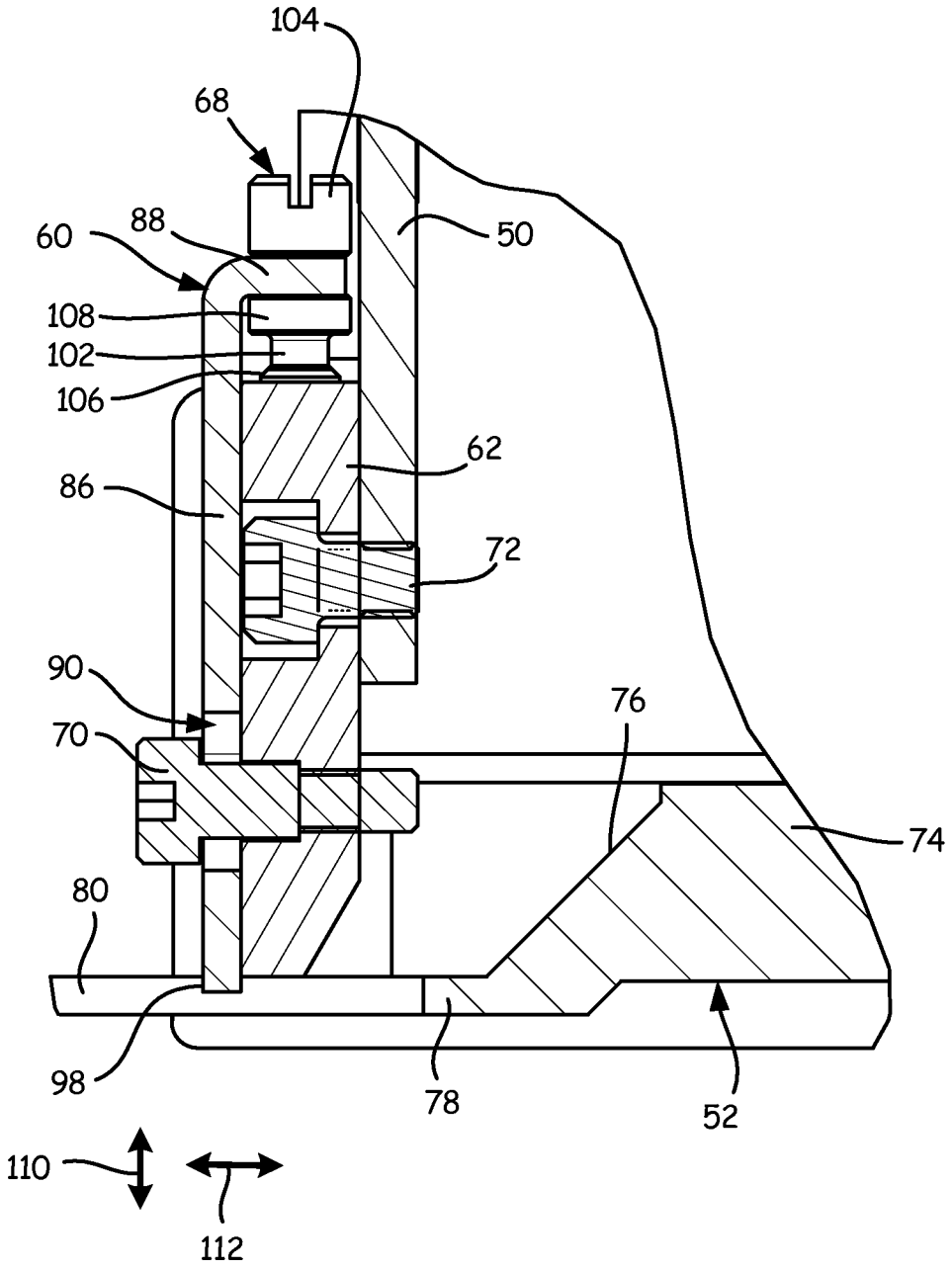
FIG. 4B is a cross-sectional view of the screed die box taken along line L-L in FIG. 3A with the dual-line screed plate fully up and the dual-line screed bar fully open.

FIG. 4A is a cross-sectional view of screed die box 46 taken along line L-L in FIG. 3A with screed plate 60 in a fully down position and screed bar 52 fully closed. FIG. 4B is a cross-sectional view of screed die box 46 taken along line L-L in FIG. 3A with screed plate 60 in a fully up position and screed bar 52 fully open.

Positioning screw 68 includes positioning screw shaft 102, positioning screw head 104 located at one end of positioning screw shaft 102, and positioning screw thread 106 located on positioning screw shaft 102 opposite positioning screw head 104. Located along positioning screw shaft 102 and spaced apart from positioning screw head 104 is positioning screw shoulder 108. Positioning screw thread 106 is threaded into screed plate mount 62. Screed plate 60 is positioned adjacent screed plate mount 62 such that positioning screw shaft 102 is arranged within positioning aperture 92. Positioning screw shoulder 108 and positioning screw head 104 are both wider than positioning aperture 92 (best seen in FIG. 3B). In this way, positioning screw 68 determines the height of screed plate 60, and screed plate 60 may be raised or lowered relative to screed plate mount 62 by rotating positioning screw 68.

Screed plate mount 62 is mounted to screed bucket 50 by mount screws 72. Screed plate 60 is secured to screed plate mount 62 by retaining screws 70 that extend through retaining slots 90 and into screed plate mount 62. Because retaining slot 90 is vertically taller than the shaft of retaining screw 70, screed plate 60 can move substantially parallel to the aft side of screed bucket 50 in screed plate direction 110 when positioning screw 68 is rotated to adjust the height of screed plate 60. Moving screed plate 60 parallel to the aft side of screed bucket 50 allows the user to set the thickness of the thermoplastic being laid down by adjusting the height of screed flanges 98 above the pavement.

As shown in FIG. 4A, sealing lip 78 engages a bottom edge of screed plate mount 62 when screed bar 52 is in a closed position. Sealing lip 78 engaging the bottom edge of screed plate mount 62 closes screed bucket 50 to prevent thermoplastic from exiting screed bucket 50. Projection 80 extends aft of screed plate 60 and through notch 96 (best seen in FIG. 3B). As previously stated, the user causes screed bar 52 to shift to an open position along screed bar direction 112 by rotating screed lever 48.

As shown in FIG. 4B, sealing lip 78 is disengaged from the bottom edge of screed plate mount 62 when screed bar 52 is in an open position. The gap between sealing lip 78 and screed plate mount 62 defines a flow path for thermoplastic to exit screed bucket 50. As can be seen, projection 80 engages the bottom edge of screed plate mount 62 when screed bar 52 is in an open position, thereby preventing thermoplastic from exiting screed die box 46 at projection 80. In this way, projection 80 defines the gap between the lines of thermoplastic exiting screed die box 46.

Screed flanges 98 can extend below projection 80 and into the flow paths of thermoplastic exiting screed bucket 50. Notch 96 allows screed flanges 98 to extend below of top of projection 80 and sealing lip 72 without being hindered by projection 80, as projection 80 extends through notch 96. In this way, screed flanges 98 may extend into the flow path of the thermoplastic, while projection 80 maintains a seal with screed plate mount 62 to prevent thermoplastic from exiting screed bucket 50 at projection 80.

Figure 5A:
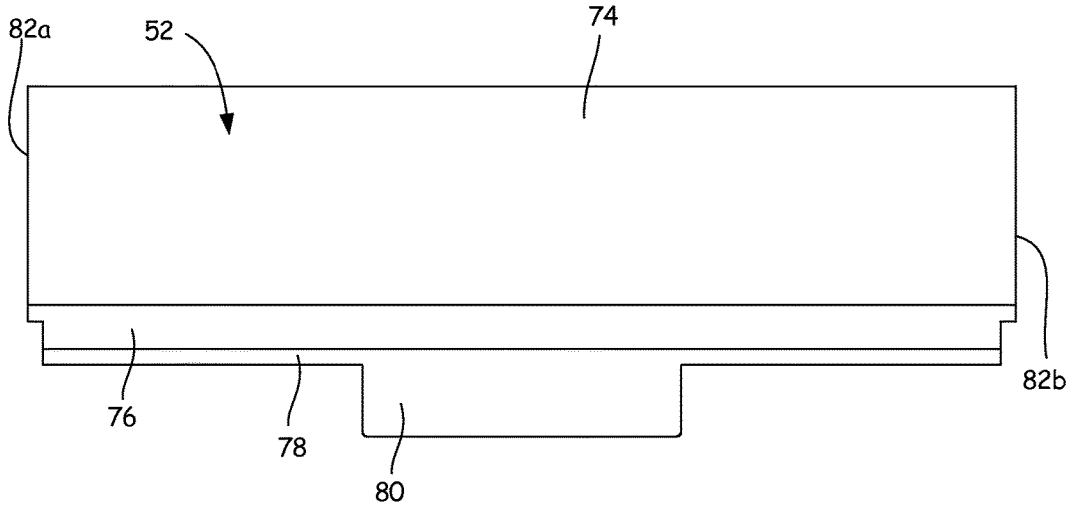
FIG. 5A is a plan view of a dual-line screed bar.
Figure 5B:
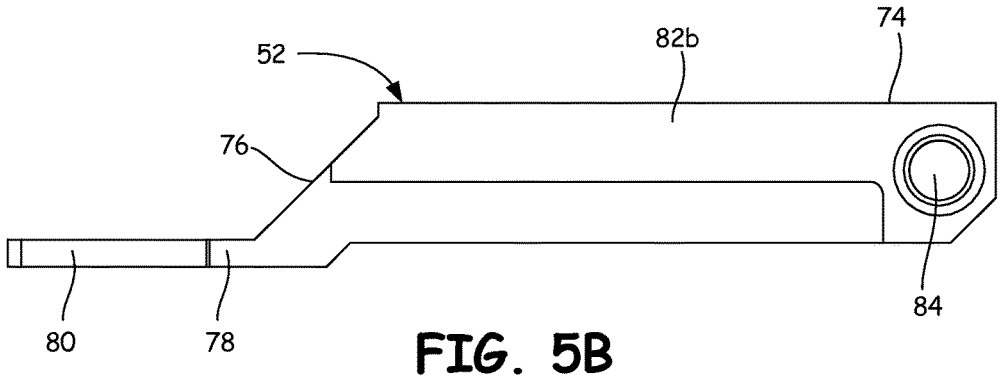
FIG. 5B is a side elevation view of a dual-line screed bar.
Figure 5C:
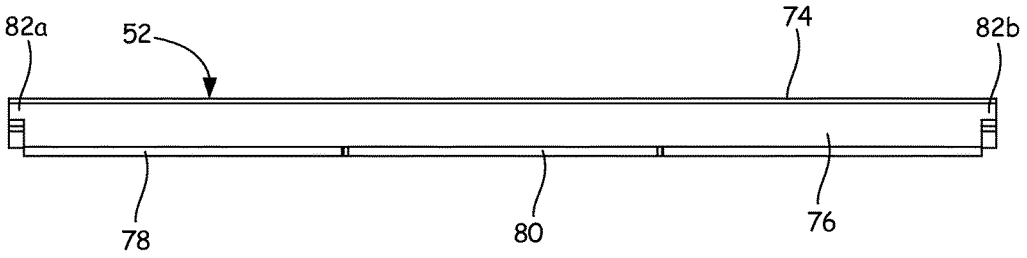
FIG. 5C is a front elevation view of a dual-line screed bar.

FIG. 5A is a plan view of screed bar 52. FIG. 5B is a side elevation view of screed bar 52. FIG. 5C is a front elevation view of screed bar 52. FIGS. 5A-5C will be discussed together. Screed bar 52 includes body 74, sloped edge 76, sealing lip 78, projection 80, mounting rails 82*a*, 82*b*, and bolt opening 84. In the present illustrated embodiment, screed bar 52 is a dual-line screed bar, which is a screed bar that allows two, parallel lines of thermoplastic material to be laid down simultaneously.

Sloped edge 76 is located at an aft end of body 74. Sealing lip 78 projects horizontally from a bottom, aft portion of sloped edge 76. Projection 80 extends horizontally from sealing lip 78. As shown, a thickness of sealing lip 78 is equal to a thickness of projection 80. It is to be understood, however, that sealing lip 78 and projection 80 may have different thicknesses so long as projection 80 is configured to maintain a seal with the bottom edge of screed plate mount 62 when screed bar 52 is in an open position, as previously discussed.

Mounting rails 82*a*, 82*b* are located on the left and right sides of screed bar 52. Mounting rails 82*a*, 82*b* extend lengthwise along screed bar 52 from sloped edge 76 towards a forward end of body 74. Bolt openings 84 are located forward of mounting rails 82*a*, 82*b* and are configured to receive bolts 58 (shown in FIG. 3A). In this way, when screed lever 48 (best seen in FIG. 3A) rotates aft, exerting a forward force on bolts 58, bolts 58 cause screed bar 52 to slide forward. Sliding screed bar 52 forward opens a gap for thermoplastic material to flow out of screed die box 46.

In the present embodiment, screed bar 52 is configured to allow the user to lay multiple lines of thermoplastic material. The width of screed die box 46 determines the width of the line of thermoplastic laid on the pavement. The width of projection 80 determines the width of the gap between each stripe of thermoplastic material. For example, a 12 inch (30.48 centimeter) screed die box 46 may be utilized to set down two 4 inch (10.16 centimeter) thermoplastic stripes with a 4 inch (10.16 centimeter) gap therebetween. To set down thermoplastic of the desired width, projection 80 would be 4 inches (10.16 centimeters) wide. A 4 inch (10.16 centimeter) wide projection 80 creates a 4 inch (10.16 centimeter) wide gap between the two flow paths exiting screed die box 46 on either side of projection 80.

One of skill in the art will understand that although screed bar 52 is shown as a dual-line screed bar having a single projection 80, a dual-line screed bar may have a plurality of projections such that the gap between each projection will allow for flow of thermoplastic. For example, where the same 12 inch (30.48 centimeter) wide screed box is installed and two 3 inch (7.62 centimeter) stripes with a 3 inch (7.62 centimeter) gap between the two stripes is desired, the dual-line screed bar may include two edge projections that are 1.5 inches (3.81 centimeters) wide and a central projection that is 3 inches (7.62 centimeters) wide. In this way, the 12 inch (30.48 centimeter) wide screed box will have two 3 inch (7.62 centimeter) wide flow paths, located in the gaps between the projections, for the thermoplastic material to flow through.

Thus, screed bar 52 may be interchanged with another screed bar, configured to lay down thermoplastic stripes of different widths or with a gap of a different width, utilizing the same screed die box. For example, the same 12 inch (30.48 centimeter) screed die box may lay down a single 12 inch (30.48 centimeter) wide thermoplastic stripe by utilizing a 12 inch (30.48 centimeter) wide screed bar without any projections. The user can then lay down two, parallel 4 inch (10.18 centimeter) thermoplastic stripes with a 4 inch (10.18 centimeter) gap therebetween by substituting a screed bar having a 4 inch (10.18 centimeter) projection 80, defining the gap between the two flow paths, and a screed plate having a 4 inch (10.18 centimeter) notch 96 to allow projection 80 to slidably extend aft of screed plate 60. Therefore, the user may efficiently switch between applying a single thermoplastic stripe and multiple thermoplastic stripes without having to change applicators or screed boxes. Similarly, the user may efficiently apply two, parallel thermoplastic stripes of various widths with gaps of various widths without having to substitute out and position screed die boxes of various widths.

Figure 6A:
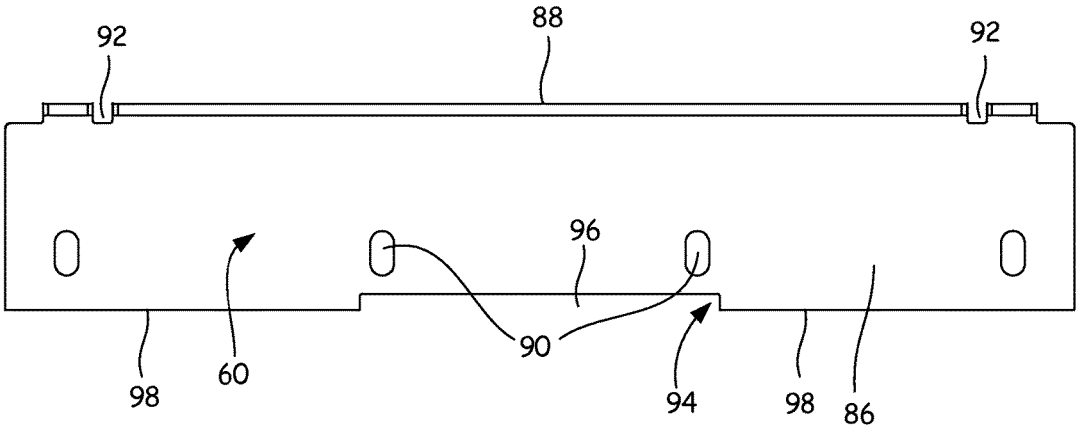
FIG. 6A is a front elevation view of a dual-line screed plate.
Figure 6B:
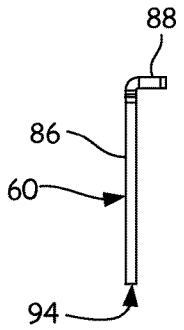
FIG. 6B is a side elevation view of a dual-line screed plate.
Figure 6C:
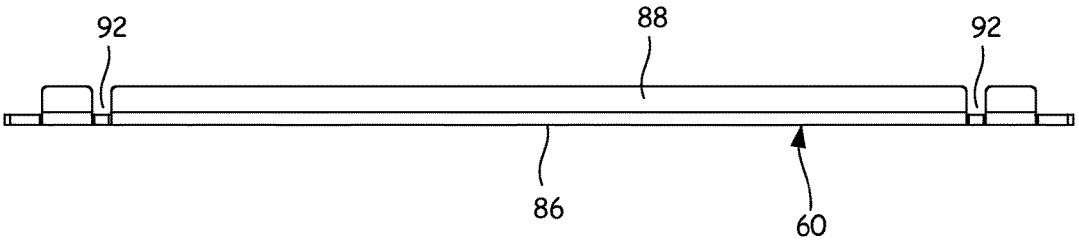
FIG. 6C is a plan view of a dual-line screed plate.

FIG. 6A is a rear elevation view of screed plate 60. FIG. 6B is a side elevation view of screed plate 60. FIG. 6C is a plan view of screed plate 60. FIGS. 6A-6C will be discussed together. Screed plate 60 includes vertical portion 86, horizontal portion 88, retaining slots 90, and positioning apertures 92. Vertical portion 86 includes lower lip 94, and lower lip 94 includes notch 96 and screed flanges 98.

Horizontal portion 88 is located at the top of vertical portion 86 and projects forward towards screed die box 46 (shown in FIG. 3A). Positioning apertures 92 are configured to accept positioning screws 68 (shown in FIG. 3A). Retaining slots 90 project through vertical portion 86, and retaining slots 90 are configured to accept retaining screws 70 (shown in FIG. 3A) to secure screed plate 60 relative to screed plate mount 62 (shown in FIG. 3A). Lower lip includes notch 96 and screed flanges 98. Notch 96 allows projection 80 (best seen in FIG. 5A) to slide freely fore and aft without engaging screed flanges 98. Where screed plate 60 is in a fully lowered position, screed flanges 98 extend below a top of projection 80 and into the flow of thermoplastic material exiting screed die box 46 and screed flanges 98 thus affect the flow of the thermoplastic.

During operation screed plate 60 can be moved vertically relative to screed plate mount 62 (shown in FIG. 3A). When the screed plate 60 is fully down, notch 96 allows projection 80 to slide horizontally and project aft of screed plate 60. As previously mentioned, thermoplastic exits the screed box on either side of projection 80. In the illustrated embodiment, screed plate 60 is a dual-line screed plate, which is a screed plate utilized to lay down two parallel stripes of thermoplastic material with a gap between the two stripes. Screed flanges 98 project into the flow path of the thermoplastic as the thermoplastic exits the screed box. In this way, screed flanges 98 restrict the flow of the thermoplastic such that a desired amount is applied to the pavement surface. Screed plate 60 can be moved vertically to position screed flanges 98 a set height above the pavement. The height at which screed flanges 98 are set determines the thickness of the thermoplastic stripes laid down.

For example, where screed bar 52 (best seen in FIG. 5A) is configured to lay down two, parallel 4 inch (10.18 centimeter) thermoplastic stripes with a 4 inch (10.18 centimeter) gap therebetween, then screed bar 52 will include a 4 inch (10.18 centimeter) wide projection 80, as previously discussed. Screed plate 60 will then include a 4 inch (10.18 centimeter) notch 96 to allow projection 80 to extend aft of screed plate 60. Screed plate 60 will also include two 4 inch (10.18 centimeter) screed flanges on either side of notch 96, which can extend into the flow paths of the thermoplastic. As such, where 0.125 inch (0.318 centimeter) thick thermoplastic stripes are desired, screed plate 60 will be positioned such that screed flanges 98 are positioned 0.125 inches (0.318 centimeters) above the pavement as the thermoplastic is applied.

Figure 7A:
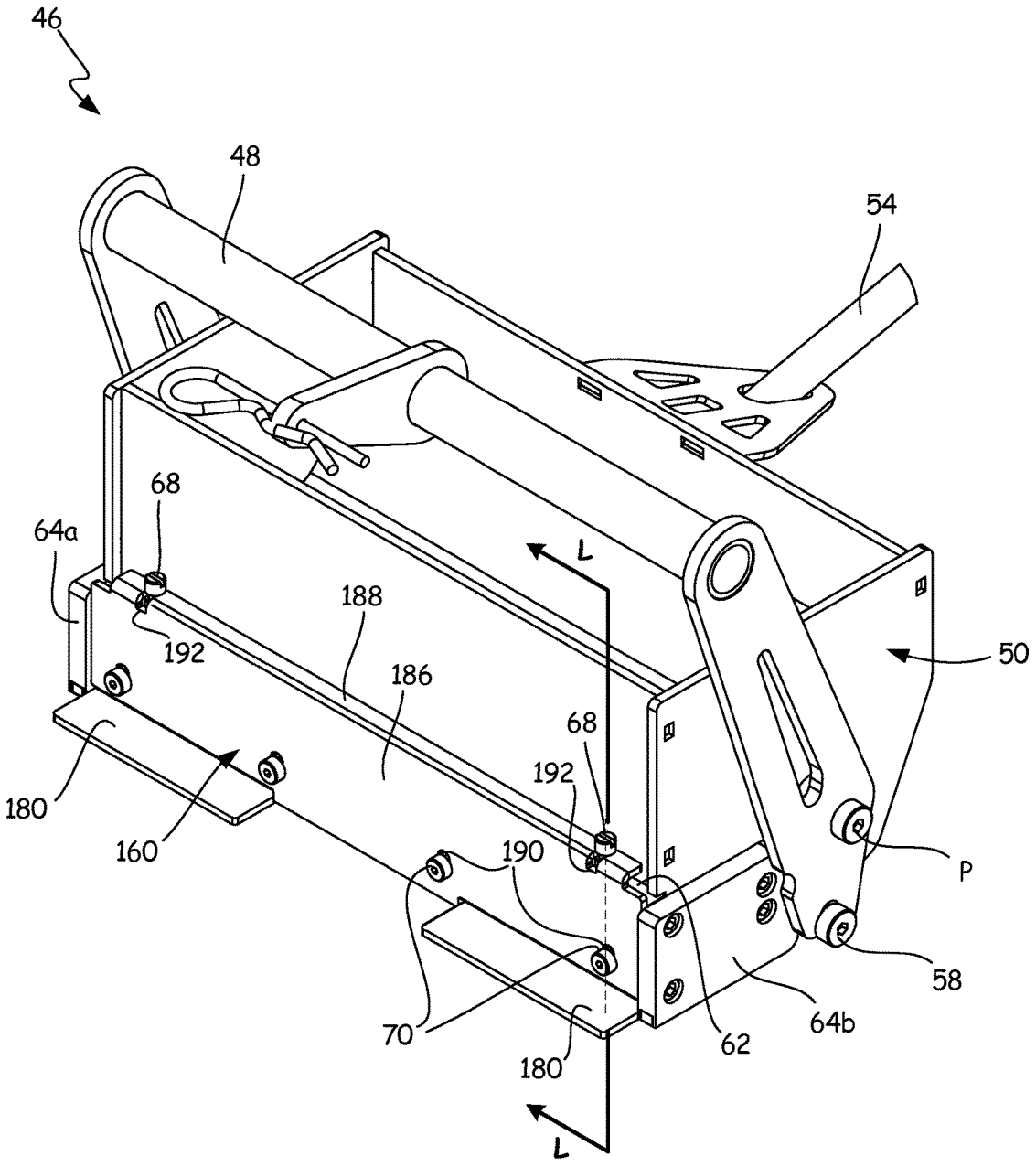
FIG. 7A is a perspective view of a screed die box.
Figure 7B:
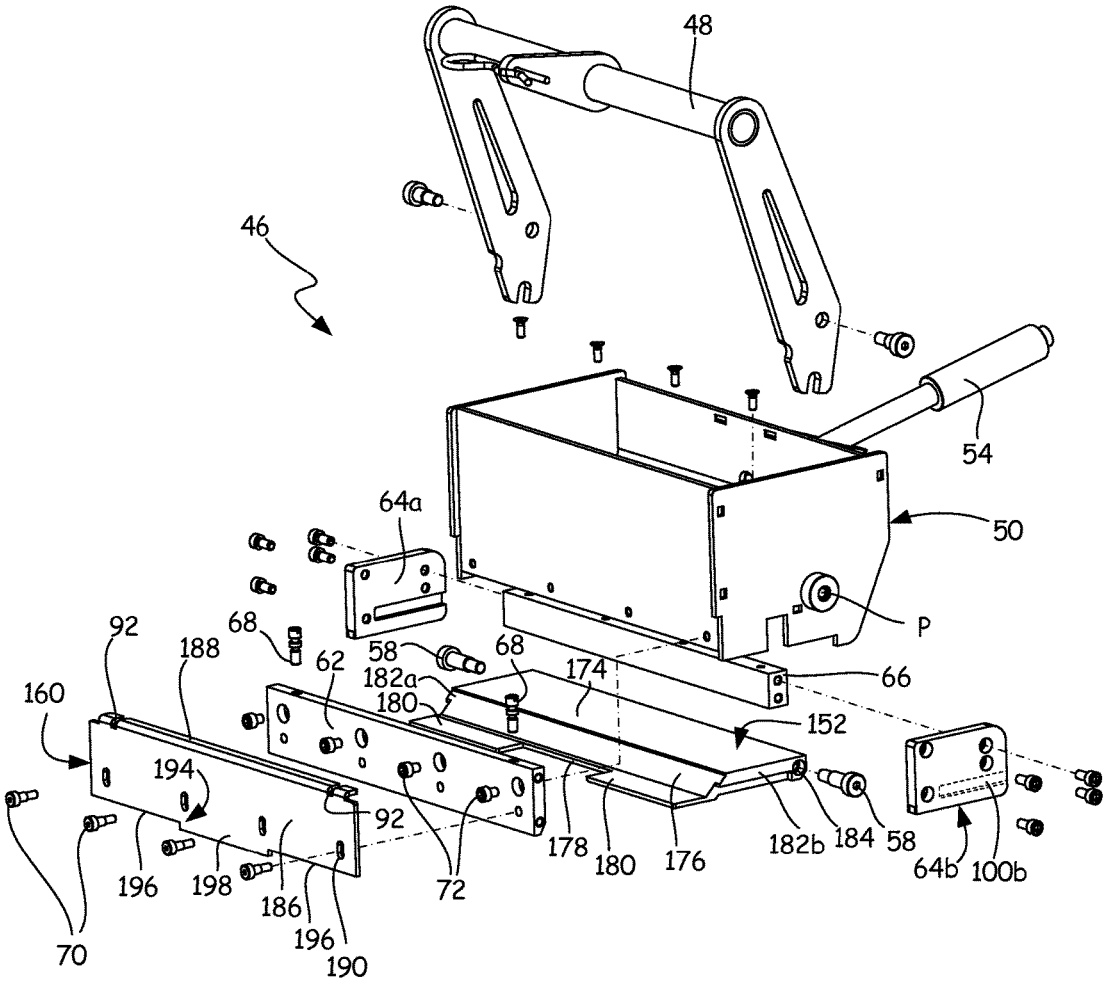
FIG. 7B is an exploded perspective view of the screed die box of FIG. 7A.

FIG. 7A is a perspective view of screed die box 46. FIG. 7B is an exploded perspective view of screed die box 46. FIGS. 7A and 7B will be discussed together. Screed die box 46 includes screed lever 48, screed bucket 50, screed bar 152, screed box anchor 54, screed plate 160, screed plate mount 62, screed bar mounts 64*a* and 64*b*, support bar 66, positioning screws 68, retaining screws 70, mount screws 72, and pivot point P.

In the illustrated embodiment, screed bar 152 includes body 174, sloped edge 176, sealing lip 178, projections

180*a,* 180*b,* mounting rails 182*a,* 182*b,* and bolt opening 184. Screed plate 160 includes vertical portion 186, horizontal portion 188, retaining slots 190, and positioning apertures 192. Vertical portion 186 includes lower lip 194, and lower lip 194 includes notch 196 and screed flange 198. Screed bar mount 64*a* includes slot 100*a,* and screed bar mount 64*b* similarly includes slot 100*b.*

Screed plate mount 62 is attached to the aft side of screed bucket 50 by mount screws 72 that extend through screed plate mount 62 and into screed bucket 50. Support bar 66 is mounted to screed bucket 50 at a forward end of screed bucket 50. Screed bar mount 64*a* is positioned at a left side of screed bucket 50. Screed bar mount 64*a* is secured to screed plate mount 62 and support bar 66 by fasteners extending through screed bar mount 64*a* and into screed plate mount 62 and support bar 66. Screed bar mount 64*b* is similarly positioned at a right side of screed bucket 50. Screed bar mount 64*b* is secured to screed plate mount 62 and support bar 66 by fasteners extending through screed bar mount 64*b* and into screed plate mount 62 and support bar 66. Screed bar 152 is slidably connected to screed bar mounts 64*a,* 64*b* by mounting rails 182*a,* 182*b* being slidably positioned within slots 100*a,* 100*b.* Bolt 58 extends into bolt opening 184 of screed bar 52 forward of screed bar mount 64*b,* and another bolt 58 similarly extends into the opposite bolt opening 184 (not shown) located on a right side of screed bar 152 forward of screed bar mount 64*a.*

Screed lever 48 is mounted to screed bucket 50 at pivot point P. Screed lever 48 engages bolts 58 at a forward end of screed bar 152. Screed lever 48 slidably moves screed bar 152 fore by engaging bolt 58 and rotating aft, and screed lever fore and aft. As screed lever 48 rotates aft, screed lever exerts a torque on bolts 58, which causes bolts 58 to move forward. Bolts 58 exert a force on screed bar 152, causing screed bar 152 to corresponding slide forward and opening a flow path for thermoplastic to exit screed die box 46. When screed bar 152 slides forward, projections 180 do not retract beyond screed plate 160 or screed plate mount 62. As such, projections 180 prevent thermoplastic from flowing out of screed die box 46, and projections 180 create flow paths adjacent projections 180 for thermoplastic to exit screed die box 46. When screed plate 162 is in a fully down position (shown in FIG. 8A) screed flange 198 projects below a top of projections 180. Projections 180 slide horizontally through notches 196 such that screed flange 198 can extend below the top of projections 180.

Screed flange 198 projects from lower lip 194 of screed plate 160 and into the gap located between projections 180. Screed flange 198 projects into the flow path of the thermoplastic exiting the screed die box 46. Screed flange 198 can determine the thickness of the stripe of thermoplastic exiting screed die box 46. Screed plate 160 can be adjusted vertically such that screed flange 198 is set a predetermined height above the pavement, the predetermined height being the thickness of the thermoplastic stripe. Notches 196 allow projections 180 to slide freely fore and aft with screed flange 198 disposed between projections 180.

In the present embodiment, screed bar 152 is a single-line screed bar, and screed plate 160 is a single line screed plate 160. As such, as screed bar 152 slides forward a single flow path is opened for thermoplastic to exit screed die box 46. The flow path is disposed between projections 180, and screed flange 194 can extend into the flow path. While screed bar 152 and screed plate 160 are configured to lay down a single stripe at a desired width. Screed bar 152 and screed plate 160 allow the user to efficiently lay down thermoplastic stripes of various widths and thicknesses with a single screed die box.

For example, if screed die box 46 is a 6 inch (15.24 centimeter) screed box, then screed die box 46 will lay down a 6 inch (15.24 centimeter) wide line of thermoplastic where the screed bar does not include any projections. Where a 3 inch (7.62 centimeter) wide line is desired, the user can replace the standard screed plate with a screed plate having a 3 inch (7.62 centimeter) wide screed flange 194, and replace the standard screed bar with a screed bar having two 1.5 inch (3.81 centimeter) wide projections 180 extending from the right and left side of the sealing lip 178, which creates a 3 inch (7.62 centimeter) gap between the two projections 180. As such, a 3 inch (7.62 centimeter) flowpath is created between the two projections 180 and screed flange 194, which allows the user to lay down a 3 inch (7.62 centimeter) wide thermoplastic stripe with the same 6 inch (15.24 centimeter) screed die box 46.

Similarly, a 3 inch (7.62 centimeter) wide thermoplastic stripe may be laid down with a 12 inch (30.48 centimeter) screed box. A screed bar having 4.5 inch (11.43 centimeter) wide projections 180 with a 3 inch (7.62 centimeter) gap therebetween, and a screed plate having a 3 inch (7.62 centimeter) screed flange 194 would be installed on the 12 inch (30.48 centimeter) screed box, which would create a 3 inch (7.62 centimeter) flow path for thermoplastic to exit the screed box. One skilled in the art will understand that projections 180 and screed flange 194 can be configured to allow screed die box 46 of any suitable size to lay down a thermoplastic stripe of any desired width.

Figure 8A:
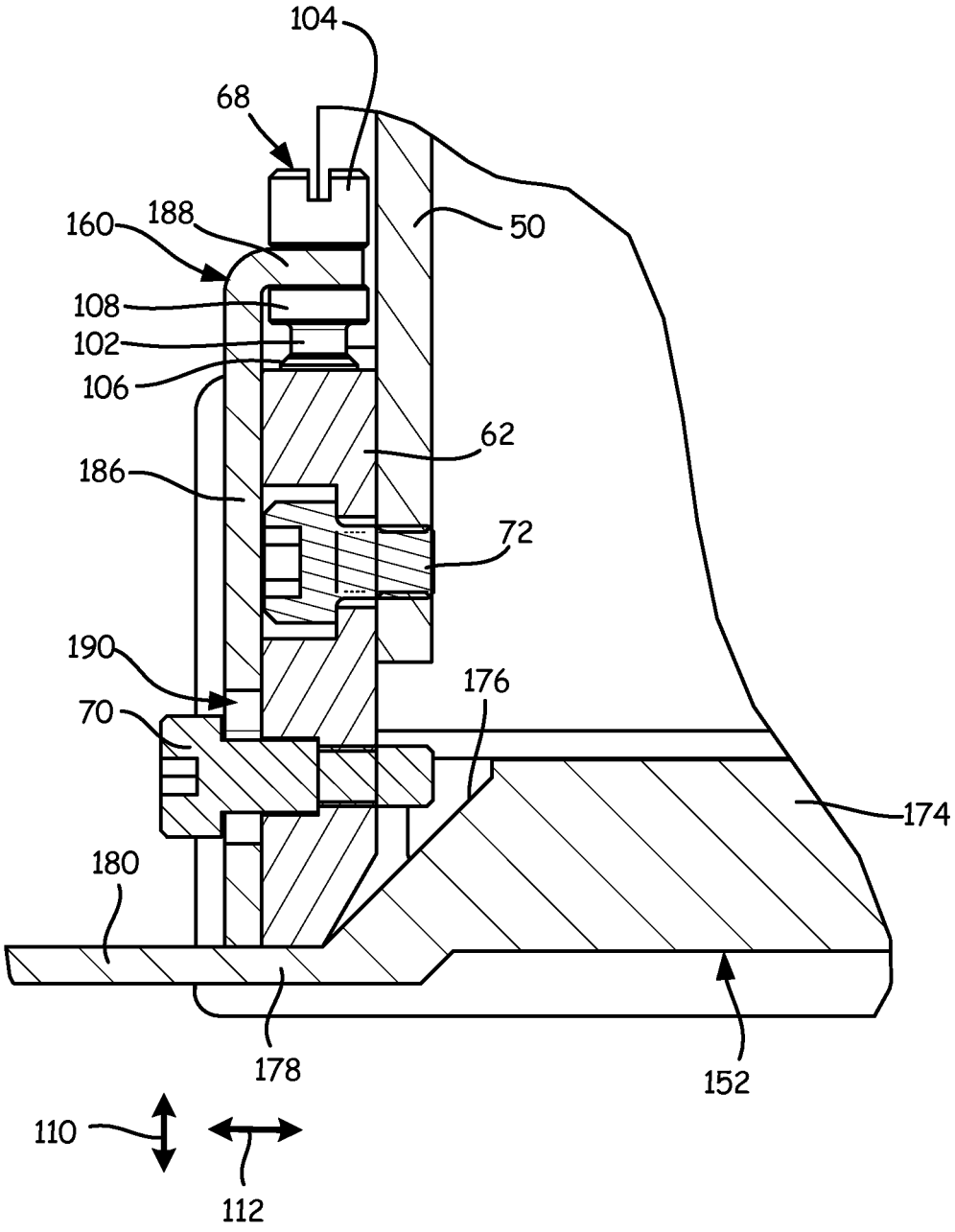
FIG. 8A is a cross-sectional view of the screed die box taken along line L-L in FIG. 3A with a single-line screed plate fully down and a single-line screed bar fully closed
Figure 8B:
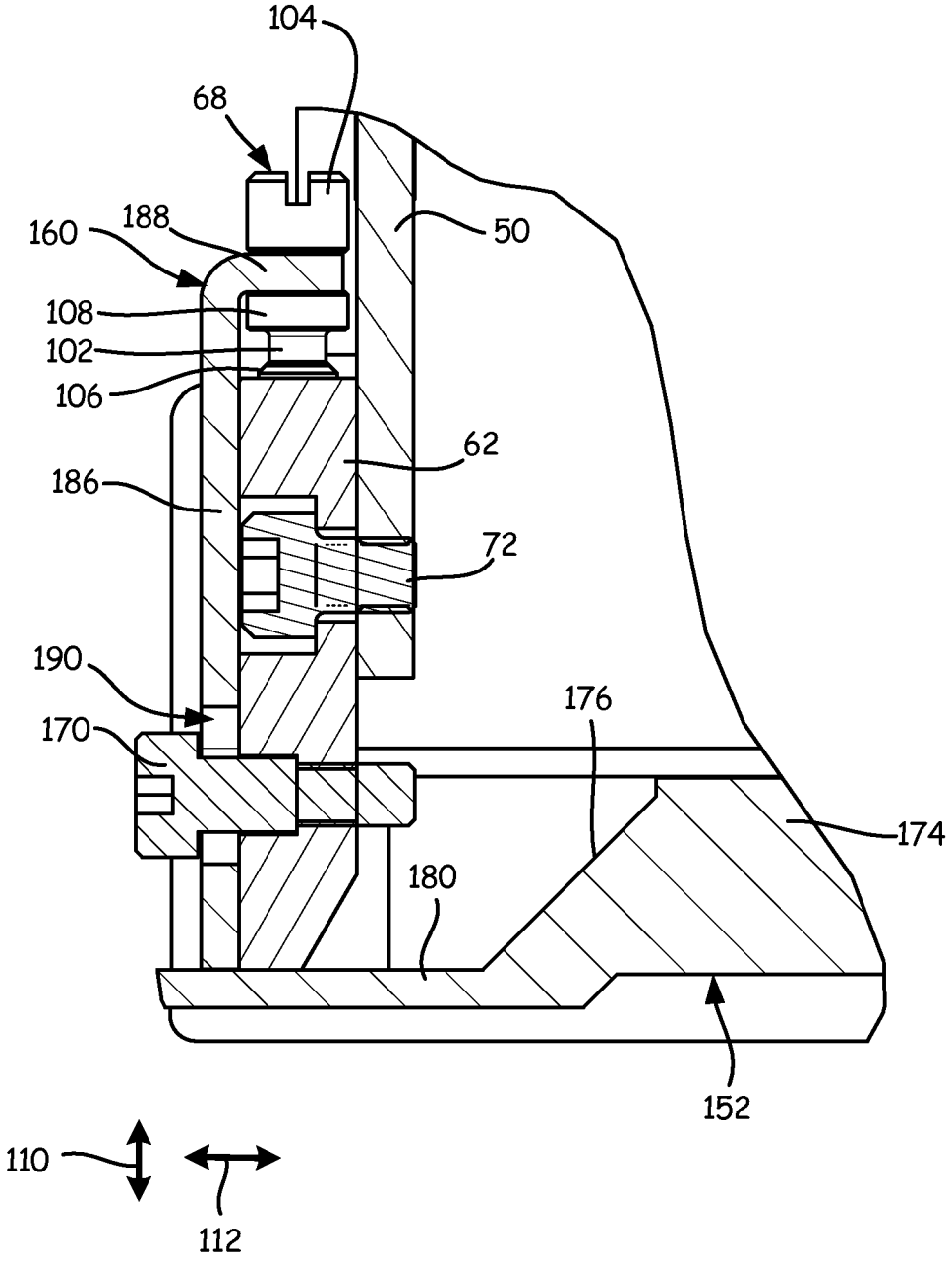
FIG. 8B is a cross-sectional view of the screed die box taken along line L-L in FIG. 3A with the single-line screed plate fully up and the single-line screed bar fully open.

FIG. 8A is a cross-sectional view of screed die box 46 taken along line L-L in FIG. 7A with screed plate 160 in a fully down position and screed bar 152 fully closed. FIG. 8B is a cross-sectional view of screed die box 46 taken along line L-L in FIG. 7A with screed plate 160 in a fully up position and screed bar 152 fully open. FIGS. 8A and 8B will be discussed together.

Positioning screw 68 includes positioning screw shaft 102, positioning screw head 104 located at one end of positioning screw shaft 102, and positioning screw thread 106 located on positioning screw shaft 102 opposite positioning screw head 104. Located along positioning screw shaft 102 and spaced apart from positioning screw head 104 is positioning screw shoulder 108. Positioning screw thread 106 is threaded into screed plate mount 62. Screed plate 160 is positioned adjacent screed plate mount 62 such that positioning screw shaft 102 is arranged within positioning aperture 192. Positioning screw shoulder 108 and positioning screw head 104 are both wider than positioning aperture 192. In this way, positioning screw 68 determines the height of screed plate 160, and screed plate 160 may be raised or lowered relative to screed plate mount 62 in the screed plate direction 110 by rotating positioning screw 68.

Screed plate mount 62 is mounted to screed bucket 50 by mount screws 72. Screed plate 160 is positioned adjacent to screed plate mount 62 by retaining screws 70 extending through retaining slots 190 and into screed plate mount 62. Because retaining slot 190 is vertically taller than the shaft of retaining screw 70, screed plate 160 can move substantially parallel to the aft side of screed bucket 50. It is understood that screed plate mount 62 may be an integral part of screed bucket 50.

As shown in FIG. 8A, sealing lip 178 engages a bottom edge of screed plate mount 62 when screed bar 152 is in a closed position. Sealing lip 178 engaging bottom edge of screed plate mount 62 prevents thermoplastic from flowing out of screed bucket 50 when screed bar 152 is in a closed position. Projections 180 extend beyond screed plate 160 when screed bar 152 is in a closed position. As previously stated, the user causes screed bar 152 to shift to an open position along screed bar direction 112 by rotating screed lever 48 (best seen in FIG. 7A).

Referring specifically to FIG. 8B, sealing lip 178 is disengaged from a bottom edge of screed plate mount 62 when screed bar 152 is in an open position. The gap between sealing lip 178 and screed plate mount 62 creates a flow path for thermoplastic to exit screed die box 46. As can be seen, even when screed bar 152 is in an open position, projection 180 engages the bottom edge of screed plate mount 62, thereby restricting the flow of thermoplastic exiting screed bucket 50. Thus, the total width of screed bar 152 minus the combined width of projections 180 determines the width of the thermoplastic stripe exiting screed die box 46 after screed bar 152 shifts to an open position.

Screed flange 198 projects from lower lip 194 of screed plate 160 and into the gap located between projections 180. Screed flange 198 is thus located in the flow path of the thermoplastic as the thermoplastic exits screed bucket 50 and affects the flow of the thermoplastic. The height above the pavement that screed flange 198 is set determines the thickness of the thermoplastic stripe exiting screed die box 46. Projections 180 slide freely fore and aft through notches 196 (shown in FIG. 7B) such that screed flange 198 can extend into the thermoplastic flow path below a top edge of projections 180.

Figure 9A:
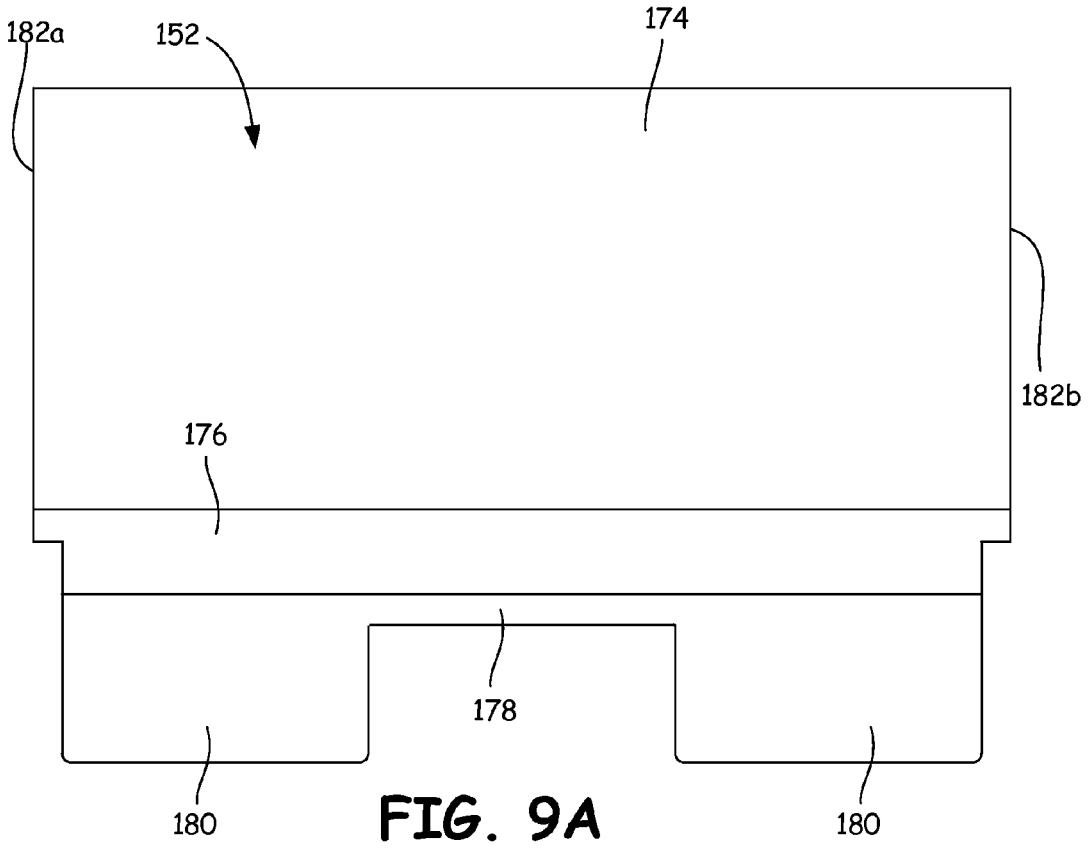
FIG. 9A is a plan view of a single-line screed bar.
Figure 9B:
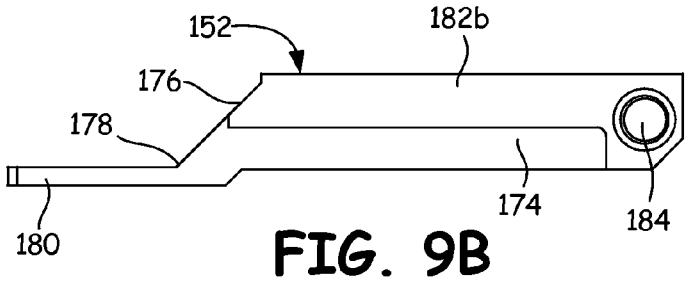
FIG. 9B is a side elevation view of a single-line screed bar.
Figure 9C:
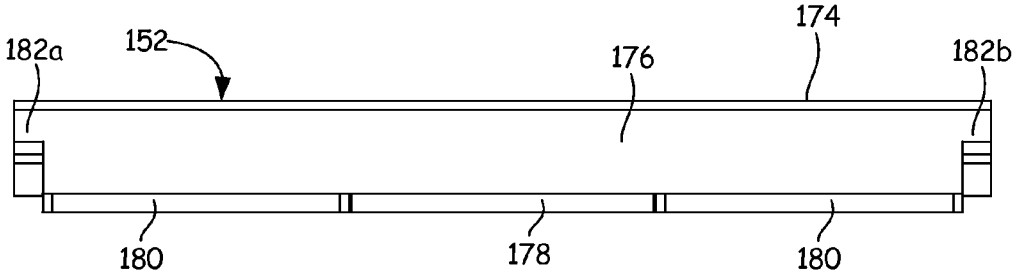
FIG. 9C is a front elevation view of a single-line screed bar.

FIG. 9A is a plan view of screed bar 152. FIG. 9B is a side elevation view of screed bar 152. FIG. 9C is a front elevation view of screed bar 152. FIGS. 9A-9C will be discussed together. Screed bar 152 includes body 174, sloped edge 176, sealing lip 178, projections 180, mounting rails 182*a*, 182*b*, and bolt opening 184. In the present illustrated embodiment, screed bar 152 is a single-line screed bar, which is a screed bar that allows a single line of thermoplastic material, of a predetermined width, to be laid on the pavement.

Sloped edge 176 is located at an aft end of body 174. Sealing lip 178 projects horizontally from a bottom, aft portion of sloped edge 176. Projections 180 extend horizontally from sealing lip 178. As shown, a thickness of sealing lip 178 is equal to a thickness of projections 180. It is to be understood that sealing lip 178 and projections 180 may have different thicknesses as projections 180 maintain a seal when screed bar 152 is in an open position, to define a width of the thermoplastic stripe exiting screed die box 46.

Mounting rails 182*a*, 182*b* are located on the left and right sides of screed bar 152. Mounting rails 182*a*, 182*b* extend lengthwise along screed bar 152 from sloped edge 176 forward towards a forward end of body 174. Bolt openings 184 are located forward of mounting rails 182*a*, 182*b* and are configured to receive bolts 58 (shown in FIG. 7A). While screed bar 152 is described as including mounting rails 182*a*, 182*b*, it is understood that screed bar 152 may be mounted to screed bucket 50 with any suitable arrangement that allows screed bar 152 to open and close a flow path for the thermoplastic.

Screed bar 152 is configured to allow the user to lay a single line of thermoplastic. The width of each line of thermoplastic material is determined by the width of sealing lip 178 minus the width of projections 180. For example, if screed die box 46 is a 12 inch (30.48 centimeter) screed die box and the user desires a 6 inch (15.24 centimeter) wide thermoplastic stripe having a thickness of 0.125 inches (0.318 centimeters), then screed bar 152 and screed plate 160 may be utilized. To obtain the single 6 inch (15.24 centimeter) stripe, screed bar 152 includes projections 180 that are each 3 inches (7.62 centimeters) wide, leaving a 6 inch (15.24 centimeter) gap between the two projections 180.

Figure 10A:
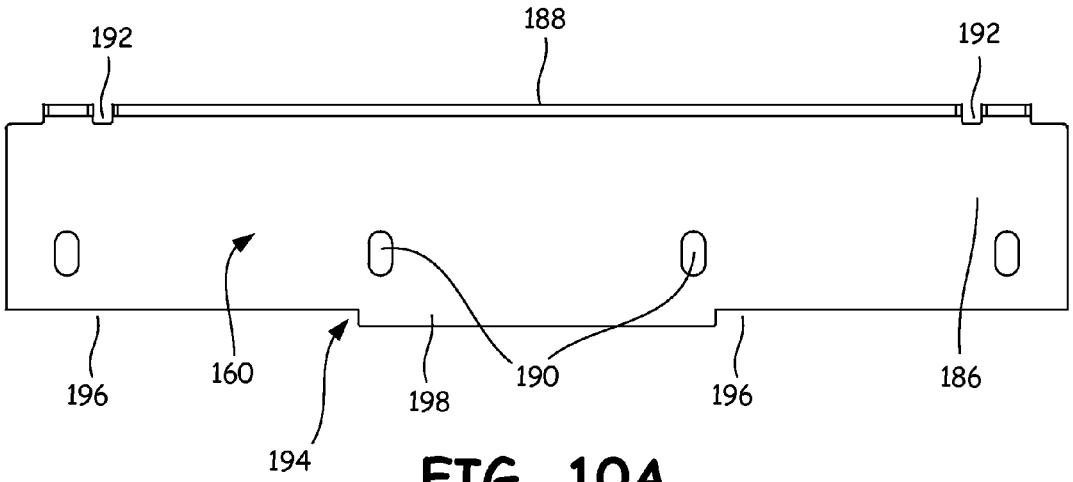
FIG. 10A is a front elevation view of a single-line screed plate.
Figure 10B:
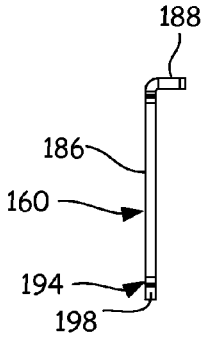
FIG. 10B is a side elevation view of a single-line screed plate.
Figure 10C:
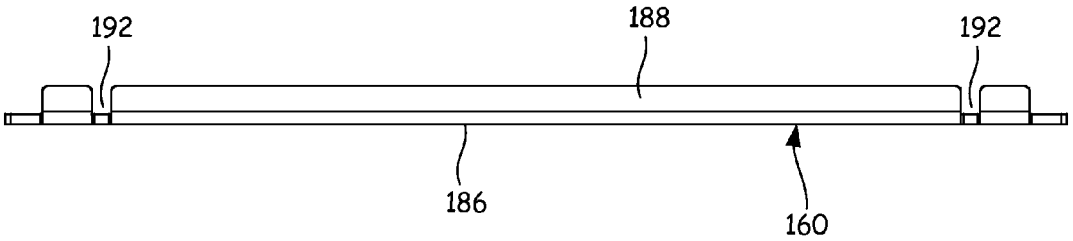
FIG. 10C is a plan view of a single-line screed plate.

FIG. 10A is a rear elevation view of screed plate 160. FIG. 10B is a side elevation view of screed plate 160. FIG. 10C is a plan view of screed plate 160. FIGS. 10A-10C will be discussed together. Screed plate 160 includes vertical portion 186, horizontal portion 188, retaining slots 190, and positioning apertures 192. Vertical portion 186 includes lower lip 194, and lower lip 194 includes notches 196 and screed flange 198.

Horizontal portion 188 is located at the top of vertical portion 186 and projects forward towards screed bucket 50. Positioning apertures 192 are configured to accept positioning screws 168 (shown in FIG. 7A). Retaining slots 190 project through vertical portion 186, and retaining slots 190 are configured to accept retaining screws 170 (shown in FIG. 7A) to secure screed plate 160 relative to screed plate mount 62 (shown in FIG. 7A). Lower lip 194 includes notches 196 configured to allow projections 180 (best seen in FIG. 9A) to slide freely where screed plate 160 is in a fully lowered position.

The illustrated embodiment of screed plate 160 is a single-line screed plate, which is a screed plate utilized to lay down a single stripe of thermoplastic material of a uniform, predetermined width and thickness. Notches 196 allow projections 180 (shown in FIG. 9A) to slide horizontally fore and aft. Screed flange 198 can project below a top edge of projections 180 into the flow path to affect the flow of thermoplastic material from screed die box 46. Screed flange 198 extends into the flow path of thermoplastic and determines the thickness of the thermoplastic stripe that is laid down.

Screed flange 198 projects into the flowpath of the thermoplastic as the thermoplastic exits the screed box. In this way, screed flange 198 restricts the flow of the thermoplastic such that a desired amount, having a desired thickness is applied to the pavement surface. For example, where a 0.125 inch (0.318 centimeter) thick thermoplastic stripe is desired, screed plate 160 will be positioned such that screed flange 198 is set 0.125 inches (0.318 centimeters) above the pavement to set the thickness of the thermoplastic stripe. Screed flange 198 projects into the gap created between projections 180, and screed flange 198 inhibits the flow of thermoplastic and sets the thickness of the thermoplastic stripe. As such, screed flange 198 has a width corresponding to the width of the gap defined between projections 180.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A screed box comprising:

a screed bucket;

a screed plate mount attached to the screed bucket, the screed plate mount including a sealing edge;

a screed plate slidably connected to the screed plate mount, the screed plate including at least one screed flange;

a screed bar attached to a bottom of the screed bucket, the screed bar comprising:

a body; and a sealing lip including at least one projection;

wherein the screed bar is slidable between an open position where the sealing lip engages the sealing edge and a closed position where the sealing lip is disengaged from the sealing edge;

wherein the at least one projection engages the sealing edge when the screed bar is in the open position and when the screed bar is in a closed position; and wherein the sealing edge, the sealing lip, and the at least one projection define at least one opening when the screed bar is in the open position.

2. The screed box of claim 1, wherein the screed bar further comprises:

a sloped edge disposed between and connecting the body and the sealing lip.

3. The screed box of claim 1, and further comprising:

a support bar mounted to the screed bucket, the support bar having a top edge and a bottom edge, the bottom edge adjacent the body of the screed bar;

a first screed bar mount attached to the support bar and the screed plate mount, the first screed bar mount comprising:

a first outer side;

a first inner side; and a first slot disposed on the first inner side;

a second screed bar mount attached to the support bar and the screed plate mount, the second screed bar mount comprising:

a second outer side;

a second inner side; and a second slot disposed on the second inner side; and wherein the screed bar further comprises:

a first rail disposed on a first edge of the body, the first rail slidably disposed within the first slot; and a second rail disposed on a second edge of the body, the second rail slidably disposed within the second slot.

4. The screed box of claim 1, wherein the screed bar slides generally horizontally with regard to the screed bucket, and the screed plate slides generally vertically with regard to the screed bucket.

5. The screed box of claim 1, wherein a thermoplastic material enters the screed box through a top of the screed box and exits through the at least one opening.

6. A mobile applicator comprising:

a frame;

a plurality of wheels rotatably connected to the frame;

a kettle attached to the frame, the kettle holding a thermoplastic material; and a screed box positioned to receive the thermoplastic material from the kettle, the screed box comprising:

a screed bucket;

a screed plate mount attached to the screed bucket, the screed plate mount including a sealing edge;

a screed plate slidably connected to the screed plate mount, the screed plate including at least one screed flange;

a screed bar attached to a bottom of the screed bucket, the screed bar comprising:

a body; and a sealing lip including at least one projection;

wherein the screed bar is slidable between an open position where the sealing lip engages the sealing edge and a closed position where the sealing lip is disengaged from the sealing edge;

wherein the at least one projection engages the sealing edge when the screed bar is in the open position and engages the sealing edge when the screed bar is in a closed position; and wherein the sealing edge, the sealing lip, and the at least one projection define at least one opening when the screed bar is in the open position.

7. The mobile applicator of claim 6, wherein the screed bar further comprises:

a sloped edge disposed between and connecting the body and the sealing lip.

8. The mobile applicator of claim 6, and further comprising:

a support bar mounted to the screed bucket, the support bar having a top edge and a bottom edge, the bottom edge adjacent the body of the screed bar;

a first screed bar mount attached to the support bar and the screed plate mount, the first screed bar mount comprising:

a first outer side;

a first inner side; and a first slot disposed on the first inner side;

a second screed bar mount attached to the support bar and the screed plate mount, the second screed bar mount comprising:

a second outer side;

a second inner side; and a second slot disposed on the second inner side; and wherein the screed bar further comprises:

a first rail disposed on a first side of the body, the first rail slidably disposed within the first slot; and a second rail disposed on a second edge side of the body, the second rail slidably disposed within the second slot.

9. The mobile applicator of claim 6, wherein the screed bar slides generally horizontally with regard to the screed bucket, and the screed plate slides generally vertically with regard to the screed bucket.

10. The mobile applicator of claim 9, and further comprising:

a screed lever, the screed lever pivotally connected to the screed bucket and attached to the screed bar; and wherein the screed lever actuates the screed bar between the open position and the closed position.

11. The mobile applicator of claim 6, wherein a thermoplastic material enters the screed box through a top of the screed box and exits through the at least one opening.

* * * * *